United States Patent [19]

Wadel

[11] Patent Number: 4,919,290

[45] Date of Patent: Apr. 24, 1990

[54] RECYCLING WASTEBASKET

[76] Inventor: L. Kathleen Wadel, 2166 W. 58th St., Indianapolis, Ind. 46208

[21] Appl. No.: 325,142

[22] Filed: Mar. 17, 1989

[51] Int. Cl.[5] ..... B65D 25/04

[52] U.S. Cl. ..... 220/1 T; 206/555; 220/22; 312/237; 312/312

[58] Field of Search ..... 206/366, 555; 211/50, 211/55, 59.2, 59.4; 220/1 T, 22, 334, 345, 404; 312/237, 309, 312

[56] References Cited

U.S. PATENT DOCUMENTS

| | | | |
|---|---|---|---|
| 87,300 | 2/1869 | Seelig | 312/237 |
| 451,436 | 4/1891 | Ramion | 206/555 |
| 566,630 | 8/1896 | Smith | 312/237 |
| 1,231,303 | 6/1917 | Seligman | 312/312 |
| 2,300,966 | 11/1942 | Roos | 312/309 |
| 2,778,704 | 1/1957 | Joachim | 312/309 |
| 2,944,861 | 7/1960 | Lessin | 312/312 |
| 4,659,154 | 4/1987 | Jenkins | 312/237 |
| 4,775,057 | 10/1988 | Zingeser | 206/366 |

FOREIGN PATENT DOCUMENTS

| | | | |
|---|---|---|---|
| 1104627 | 7/1981 | Canada | 220/404 |
| 0098672 | 1/1984 | European Pat. Off. | 312/237 |
| 3712435 | 10/1988 | Fed. Rep. of Germany | 220/334 |
| 1162500 | 9/1958 | France | 312/312 |
| 0007056 | of 1903 | United Kingdom | 206/555 |
| 0674264 | 6/1952 | United Kingdom | 211/55 |

*Primary Examiner*—Jimmy G. Foster
*Attorney, Agent, or Firm*—Robert A. Spray

[57] ABSTRACT

A salvage-facilitation device in the form of an open-topped wastebasket in its upper region, and in its lower region providing a plurality of receptacles for the convenient sorting and accommodation of pre-sorted storage of discard items; and the provision of the plurality of receptacles immediately adjacent the wastebasket hopper encouraging an automaticness of the user to pre-sort the discard items, for more assurance of resource-conservation and higher salvage value of the variety of discard items typically discarded in many offices or similar situations.

4 Claims, 1 Drawing Sheet

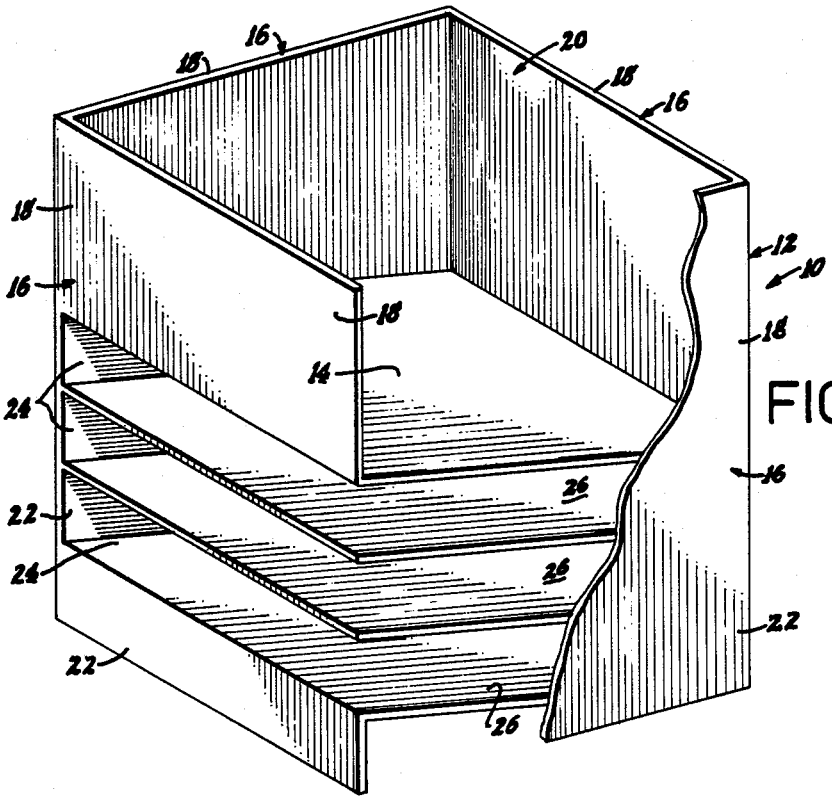
FIG.1
FIG.2
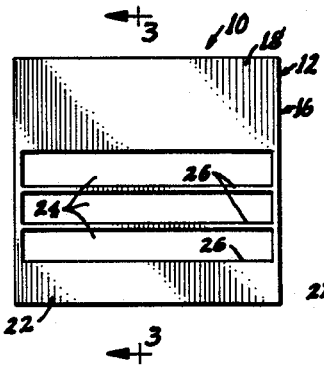
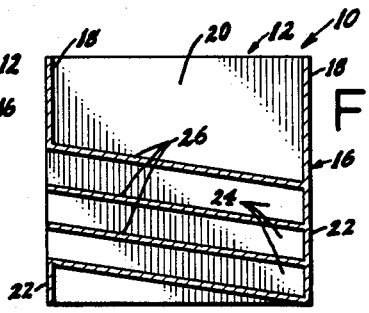
FIG.3
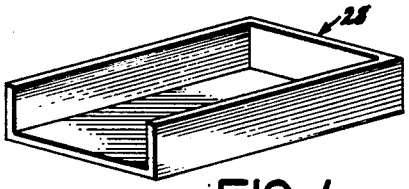
FIG.4
FIG.5
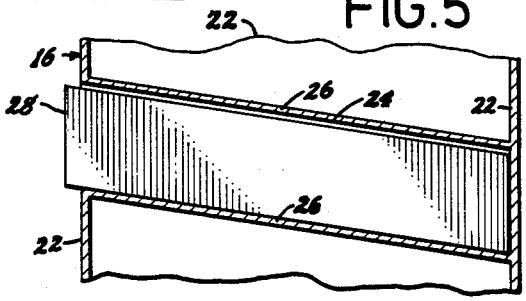

RECYCLING WASTEBASKET

FIELD OF THE INVENTION

The present invention relates to wastebaskets, and the disposal of discard items of a size conventionally discarded into a wastebasket, particularly perhaps such as that of an office in which clerical, filing, and stenographic services result in any significant bulk of paper discard of various types.

The salvage valve and re-cycling efficiency as to reclamation of paper and cardboard discards is known to be enhanced by sorting the discards into types or grades. That is, colored paper is re-cycled differently than white paper; slick paper is re-cycled differently than other texture paper; and computer paper, cardboard stock such as file folders and tablet backs, etc., each have or may have a different salvage value, making sorting of salvageable discards desirable.

Yet, in spite of the desirable sorting of salvage, the messiness and cost of a sorting operations discourages the use of refuse-sorting procedures.

THE INVENTION SUMMARIZED

According to the present invention, the task of sorting paper and other office refuse is achieved, but it is not by a sorting of the mingle of various types of refuse items, but by a device which encourages and provides a special facility and accommodation for pre-sorting of the refuse, i.e., a sorting of each sheet or group of similar refuse while discarding.

More particularly, the concepts provide a combination device, the top of which provides an open-topped wastebasket for conventional unsorted office refuse, and a lower portion of which provides a plural-tiered accommodation for pre-sorted types of office discards.

Other details and advantages, as well as the inventive nature of the overall combination invention as a whole, will be apparent as the description proceeds.

The prior art does not show the inventive concepts, even though the prior arts as to wastebaskets and storage enclosures are surely of the most ancient, and their devices are quite simple as to mechanical nature, quite open to any persons's inspection, quite easy to understand, etc.:

The prior arts as to wastebaskets and of storage enclosures are no doubt one of the most ancient as to use and knowledge, even though the basic nature of equipment in these fields has not basically changed in significant respects of the nature here involved.

The universality and age-old knowledge and use of wastebaskets and storage enclosures is so unquestionable, and since the acts of using wastebaskets and storage enclosures are such easily-observed procedures, and since most all persons have personally participated in such uses, the prior art non-origination of particularly the present combination of concepts and features is surely here to be recognized realistically as more non-obvious than many improvements would likely be in most other fields of endeavor.

With this background, the significance of the combination of concepts of the present invention is to be considered by taking these factors into realistic consideration; i.e., the centuries-long use of devices in these fields, coupled with their mechanical simplicity, their openness to observation, their easy understandability by all persons, etc., which surely all combine to indicate that creativity of significantly novel articles or devices in these fields has been in fact non-obvious to untold millions of persons for untold hundreds of years.

This general non-creativity as to basic changes has been in spite of minor or superficial changes as to these devices over the years; and such changes, e.g., as size, shape, adornment, covers, etc., apparently for obvious reasons, emphasize the lack of the world's creativity to the basic nature improvements here conceived, for which a patent award is deserved.

In a hindsight consideration of the present invention's concepts to determine its inventive and novel nature of the invention as a whole, it is not only conceded but emphasized that the prior art had multiple details of baskets and enclosures which would have been usable in this invention, but only if the prior art had had the guidance of the present concepts of the present invention; and even though resource-savings, labor savings, re-cycling of waste, etc., seem to be matters of increasing awareness, the prior art has long had much motivation as to apparatus of the present invention.

A Search in the files of the U.S. Patent Office, made after this invention was conceived and during the consideration as to whether to file for patent protection, seems to emphasize the inventive nature of this invention. In the Search, the references found on the Search were:

| U.S. Pat. No.: | Inventor: | Year: |
|---|---|---|
| 1,714,314 | G. G. Neidich | 1929 |
| 3,720,346 | D. T. Cypher | 1973 |
| 3,904,218 | E. E. Kostik | 1975 |
| 4,113,125 | R. Schiller | 1978 |
| 4,114,776 | E. Pluss | 1978 |

The Heidich device is multi-tiered, but as a dispenser its tiers are too closely spaced to provide reasonable receptacles for discards or refuse, and it is not in a combination with a wastebasket hopper.

Cypher shows a compartmentalized trash can, but it is not vertically-tiered, nor are its sorted-refuse receptacles different from a conventional wastebasket hopper; and thus its importance here is not to show anticipation or obviousness of the present invention, but to emphasize its non-obviousness by reminding that it has long been known that not only a sorting of refuse for recycling was desired, but that pre-sorting at the time of discarding was advantageous, yet the present overall concepts were not conceived until now, much later, by the present inventor.

The Kostic device is similar to that of Cypher, in respects here significant, including its reminder that the prior art still realizes the advantage of pre-sorting, yet the prior art did not conceive of the present combination.

Schiller shows separate-container features, even "filling apertures disposed above one another," but those are to receive the same type of collecting containers, a concept quite unlike the present concepts.

Pluss does not have vertically-tiered receptacles, but is noteworthy in its reminder that the prior art continued through the years to realize the advantage of pre-sorting, yet the prior art failed to achieve or conceive the present invention as a whole.

Further, it is emphasized that the prior art has had several particulars of prior art ability and motivation which individually and accumulatively help show the non-obviousness of this combination invention as to its various features:

Forming and shaping procedures and know-how as to objects of metal, wood, and plastics; knowledge of combination articles; wastebaskets of a size large enough to utilize regions for storage, wastebaskets amply large enough that a portion of their overall volume could be used for storage without significant harm to the intended wastebasket's functional needs; etc.

With the reality of all these factors, the inventive non-obviousness of the present invention is quite manifest.

The prior art has had features of the present invention, and approaches to its concepts, but not in the combination by which the invention as a whole is advantageously achieved:

The background of prior art as just summarized seems more significant in showing the non-obviousness of the present concepts when also it is reminded that the prior art also had long provided and long used principles of combination articles and combination concepts as to many types of devices, and the prior art long realized that combination was quite desirable in various devices, for a variety of uses; and metal-shaping and other material-forming and other manufacturing procedures are well known by which all components of the present invention could have been made, if the prior art had had the specific concepts of the invention.

And the existence of such articles embodying such various features is not only conceded, it is emphasized; for as to the novelty here of the combination, of the invention as considered as a whole, a contrast to the prior art helps show both the great variety of the various prior art attempts of improvement, and the advantages and the inventive significance of the present concepts. Thus, as shown herein as a contrast to all the prior art, the inventive significance of the present concepts as a combination is emphasized, and the nature of the concepts and their results can perhaps be easier understood.

Although varieties of prior art are conceded, and ample motivation is shown, and full capability in the prior art is conceded, no prior art shows or suggests details of the overall combinations of the present invention, as is the proper and accepted way of considering the inventiveness nature of the concepts.

That is, although the prior art shows an approach to the overall invention, of particularly many types and styles of enclosure cabinets as well as many types of wastebaskets, and the prior art has shown various natures of all such articles, it is significant that none of the prior art shows the novel and advantageous combination, which provides the merits of this invention, even though certain details are shown separately from this accomplishment.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility, to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art of all relevant fields.

BRIEF DESCRIPTION OF THE DRAWINGS

The above description of the novel and advantageous invention is of somewhat introductory and generalized form. More particular details, concepts, and features are set forth in the following and more detailed description of illustrative embodiments, reference being had to the accompanying generally diagrammatic and schematic drawings, in which:

FIG. 1 is an overall pictorial view, a large portion of one sidewall broken away, of a combination wastebasket and pre-sorted discard facility of the present invention;

FIG. 2 is an elevation view of the front thereof;

FIG. 3 is a vertical cross-sectional view thereof, i.e., the sidewall shown partially broken away in FIG. 1 is here shown as fully removed;

FIG. 4 is a pictorial view of a receiver tray used in another embodiment of the invention; and FIG. 5 is a fragmental cross-sectional detail view, showing one of the receiver trays of FIG. 4 installed in one of the receptacle means of the device, and resting on one of the shelves thereof.

DETAILED DESCRIPTION OF ILLUSTRATIVE EMBODIMENT

As shown in the drawings, the present invention provides a combination device having special features and special function.

The overall device 10, as seen from the top, appears to be an open-topped wastebasket 12, but it is also a device for the disposal procedure of disposing items for discard, conveniently in a sorted manner for expediting reclamation of the items for re-cycling, salvage value enhancement, etc.

As a wastebasket 12, the device's components are shown as a slanting bottom panel 14, and upstanding side walls 16 which have upwardly-extending portions 18 which extend a substantial distance upwardly of the bottom panel 14 and co-operate with the bottom panel 14 to provide an open-topped hopper 20 for discard items. As so considered, the wastebasket portion 12 of the overall device 10, with components 14 and 18, serves conventionally as a conventional wastebasket, into which the user would conventionally drop items of discard.

However, according to the special concepts of the present invention, the wastebasket device 10 is improved by concepts of means providing for the storage of other discard items in a sorted manner, and more particularly a manner which could be called a pre-sorted manner.

Achieving that special and advantageous function, the following description relates to features which are provided in combination with such a wastebasket 12.

The wastebasket device's upstanding side walls 16 have downwardly-extending portions 22 which extend a substantial distance downwardly of the wastebasket's bottom panel 14; and, below the bottom panel 14 of the hopper 20 of the wastebasket 12, there is provided a plurality of receptacle means 24. The receptacle means 24, shown as one above the other, provide for the receiving of different types of discard items in a pre-sorted manner.

More particularly, the downwardly-extending portions 22 of the sidewalls 16 in effect provide a plurality of functions. That is, they provide a base for the wastebasket 12 which supports its hopper 20 substantially above a supporting floor, they provide means for supporting the receptacle means 24, and they also provide an appearance-enhancing enclosure for the receptacle means 24.

In the form shown in FIG. 1, in which the receptacle means 24 are open along their sides, being in effect only a series of shelves 26, the downwardly-extending portions 22 of the upstanding side walls 16 also provide enclosures shielding from sight the discard items which have been put in the receptacle means 24; and in both forms shown in the drawings, the receptacle means 24 have such shelves 26, preferably as shown slanting downwardly from front to rear.

In the forms shown in FIGS. 4 and 5, the receptacle means 24 include receiver trays 28; and there are support members here shown as the shelves 26, which are supported by the downwardly-extending portions 22 of the upstanding side walls 16 and which support the receptacle means trays 28 for sliding in and out of the sorted storage portion of the wastebasket device 10.

The trays 28 make for easy removal of discard items, although if it is likely, e.g., that a receiver 24 will be assigned to receive only sheets of a certain size, a size nearly that of the shelves 26, withdrawal of the discarded sheets will be sufficiently easy that no tray 28 need be provided.

SUMMARY AND UTILITY DESIGNATIONS

A combination device 10 of either embodiment provides the advantages of a conventional wastebasket 12/20 but also provides convenience and encouragement for a user to pre-sort discard items for both economy and re-cycling conservations of resources, with each of the tiers of receivers or receptacles 24 being designated to receive a certain type of discard.

Maximum convenience is provided, by the pre-sorted receiver feature being just as close to the user's work area as the conventional wastebasket is handily kept; yet not only no extra floor space need be provided, but the immediate adjacency of the pre-sort receptacle means 24 to the wastebasket hopper 20 means that the user will inevitably be conveniently close to the pre-sort receptacles 24 each time he or she would be in the adjacency of the wastebasket hopper 20, thus providing by that adjacency a convenience to help encourage the pre-sort procedure as to discards.

Bulk of overall discard is minimized, for the pre-sorting by sheets encourages the user to not crush the paper discards into bulky wads.

The slanting of the shelves 26 provides more sureness of a stable receiving of the discard sheets; for whether or not a tray 28 is used, the access frontage of the receiver 24 or tray 28 is desirably open for ease of discard and withdrawal.

CONCLUSION

It is thus seen that a salvage-facilitation device, as provided and used according to the inventive concepts herein set forth, provides novel concepts of a desirable and advantageous device, yielding the advantages of a recycling-expediting wastebasket, having advantageous details and features, which, in overall combination, is conceptually different from the prior art articles even though various objects embodying certain of the mechanical details as a basic capability have of course been known for years; yet significantly this particular combination, even considered as including or building on prior art concepts, has not been suggested by the prior art, this achievement being a substantial and advantageous departure from prior art, all this even though the prior art shows attempts at improvement and variations as to devices for trash-discard and storage-enclosures for many years. And particularly is the overall difference from the prior art significant when the non-obviousness is viewed by a consideration of the subject matter as a whole, as integrally incorporating a combination of features as different from the prior art, in contrast to merely those details of novelty themselves, and further in view of the prior art teaching away from the particular and inter-related concepts and features of the present invention.

In summary as to the nature of these advantageous concepts, their inventiveness is shown by novel features of concept and construction shown here, in novel and advantagous combination, not only being different from all the prior art known, but because the achievement is not what is or has been suggested to those of ordinary skill in the art, especially realistically considering this as comprising components which individually are similar in nature to what is well known to makers and users of various wastebaskets and storage devices for many years. No prior art has suggested the modifications of any prior art to achieve the novel concepts here achieved, with the various features providing their own functions in the overall combination; and this is particularly significant since these devices are probably in the oldest fields of art ever known, and because both of them are objects whose mechanisms are easy and apparent to observe, and have been no doubt observed by most all persons the world over, for all ages.

Accordingly, it will thus be seen from the foregoing description of the invention according to this illustrative embodiment, considered with the accompanying drawings, that the present invention provides new and useful concepts of a novel and advantageous combination trash and sorted-storage device yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

I claim:

1. An open-topped wastebasket for the disposal of discard items in a sorted manner for expediting reclamation thereof, the wastebasket comprising:

a bottom panel, upstanding side walls having upwardly-extending portions extending a substantial distance upwardly of the bottom panel, the upwardly-extending portions co-operating with the bottom panel to provide an open-topped hopper for discard items, the wastebasket being improved by means providing for the storage of discard items in a sorted manner, and comprising the following in combination with such a wastebasket:

the provision that the wastebasket's upstanding side walls have downwardly-extending portions extending a substantial distance downwardly of the wastebasket's bottom panel, and there is also provided a plurality of receptacle means below the said bottom panel of the wastebasket, for receiving, respectively, different types of discard items, the said downwardly-extending portions providing a plurality of functions as follows:

(a) they provide a base for the wastebasket which supports the wastebasket substantially above a supporting floor, and (b) the said downwardly-extending portions also provide means for supporting the receptacle means, and (c) the said downwardly-extending portions also provide an enclosure for the receptacle means; and in which the receptacle means includes receiver trays; and there are support members, which are supported by the downwardly-extending portions of the upstanding side walls, and which support the receptacle means for sliding in and out of the wastebasket; and in which the support members provide a downwardly slanting front-to-rear support of the receiver trays, such that when installed in the wastebasket they slant downwardly from front to rear.

2. The wastebasket as set forth in claim 1, in which the receptacle means are provided to be in a vertically-arranged series.

3. A salvage-facilitation device, in a combination including an open-topped wastebasket hopper, for providing for the disposal of a plurality of types of salvageable discard items in a sorted and sorted-storage manner for expediting the reclamation thereof, the device comprising:

a panel and upstanding side walls, the panel providing a bottom panel of the wastebasket hopper, and the upstanding side walls having upwardly-extending portions extending a substantial distance upwardly of the panel, and also having downwardly-extending portions extending a substantial distance downwardly of the panel, the upwardly-extending portions co-operating with the panel to provide an open-topped wastebasket hopper for discard items, the device also providing for the sorting and sorted storage of salvageable discard items, by providing, in combination with such a wastebasket hopper, a plurality of receptacle means, below the said bottom panel of the wastebasket hopper, for receiving, respectively, different types of discard items, the said downwardly-extending portions providing a plurality of functions as follows:

(a) they provide a base for the wastebasket hopper which supports the wastebasket hopper substantially above a supporting floor, and (b) the said downwardly-extending portions also provide means for supporting the receptacle means, and (c) the said downwardly-extending portions also provide an enclosure for the receptacle means; and in which the receptacle means include receiver trays; and there are support members, which are supported by the downwardly-extending portions of the upstanding side walls, and support the receptacle means for sliding in and out of the device; and in which the support members provide a downwardly slanting front-to-rear support of the receiver trays, such that when installed in the device they slant downwardly from front to rear.

4. The salvage-facilitation device as set forth in claim 3, in which the receptacle means are provided to be in a vertically-arranged series.

* * * * *